United States Patent [19]

Holladay

[11] 4,143,838

[45] Mar. 13, 1979

[54] FOLDING FIN ASSEMBLY DETENT

[75] Inventor: Samuel P. Holladay, Westlake Village, Calif.

[73] Assignee: The United States of America as represented by the Secretary of the Navy, Washington, D.C.

[21] Appl. No.: 826,280

[22] Filed: Aug. 22, 1977

[51] Int. Cl.[2] ..... F42B 13/32

[52] U.S. Cl. ..... 244/3.28

[58] Field of Search ..... 244/3.27, 3.28, 3.29; 403/93, 96

[56] References Cited

U.S. PATENT DOCUMENTS

| | | | |
|---|---|---|---|
| 2,719,688 | 10/1955 | Seifert | 403/106 |
| 2,725,011 | 11/1955 | Sundermann et al. | 102/270 |
| 2,801,587 | 8/1957 | Gould | 244/3.28 |
| 3,369,316 | 2/1968 | Miller | 42/72 |
| 3,583,734 | 6/1971 | Magi | 403/96 |
| 3,819,132 | 6/1974 | Rusbach | 244/3.28 |

FOREIGN PATENT DOCUMENTS

| | | | |
|---|---|---|---|
| 514819 | 10/1952 | Belgium | 244/3.28 |

*Primary Examiner*—Verlin R. Pendegrass
*Attorney, Agent, or Firm*—R. S. Sciascia; W. Thom Skeer

[57] ABSTRACT

A folding fin assembly detent for reliably holding folding fins in the deployed position accurately and with relation to each other as well as to the center line of the entire missile assembly comprising a double ball detent incorporating two spring loaded hardened steel balls carried in a hole through the fin hub parallel to the fin hinge pin.

6 Claims, 3 Drawing Figures

FOLDING FIN ASSEMBLY DETENT

BACKGROUND OF THE INVENTION

1. Field of the Invention

Many missiles, including self propelled missiles which are fired by means of a launching tube, are equipped with vanes or fins which open out once the missile has left the launching tube.

In order to insure the greatest possible firing accuracy, it is advantageous for such a vane or fin system to open rapidly and accurately as soon as the missile has left the launching tube. Also, once the vanes or fins are open it is important that they be retained in a locked position.

The missile is fired from a launching tube, either smooth bore or rifled. This necessarily implies that the fins must be folded toward the axis of the projectile to permit the latter to travel through the tube, the fins opening out or unfolding as soon as the projectile leaves the tube.

2. Description of the Prior Art

One prior method of holding the folding fins in the deployed position was to employ a spring loaded lock pin seated in a hole at the bottom of the fin slot in the base plate of the projectile. The lock pin rides on the radius of the fin hub until the fin rotates to the deployed position. The stop pin is then forced, by the spring, into a step cut in the fin hub.

The fin hub is structurally weakened by the step cut. As the fin continues to rotate past the deployed position it strikes the fin slot end in the base plate with sufficient force to cause local yielding of both the fin and the fin slot end of the base plate. This results in fin rebound between the fin slot end and the stop pin of several cycles of approximately 30°. The rebound force against the stop pin is of sufficient magnitude to cause occasional stop pin failures. When this occurs, the fin, which is still attached to the base plate by a pivot pin, trails in and is eroded by the motor exhaust plume. The non-symmetrical fin configuration induced by the failure results in highly unstable missile flight characteristics and subsequent target loss by the missile.

Another method used employs the same spring loaded stop pin seated in a blind hole in the fin hub parallel to the fin pivot pin. The stop pin rides on the fin slot face until the fin rotates to the deployed position. The stop pin is then forced by the spring into a step cut in the face of the fin slot. This configuration results in the fin being forced to one side of the fin slot as the high shear force is applied to the stop pin by rebound.

A third method employs a spring loaded stop dog mounted on a pivot pin at the bottom of the fin slot. The free end of the stop dog rides on the fin hub radius until the fin rotates to the deployed position. The spring then forces the free end of the stop dog into a step cut in the fin hub radius. The fin hub is structurally weakened by the step cut. This particular mechanism is unduly complicated and difficult to assemble as well.

SUMMARY OF THE INVENTION

The present invention is directed to a folding fin arrangement for a gun fired missile which employs a double ball detent to fix the fins in proper and accurate attitude when deployed. The balls are spring biased and effectively and reliably lock the fins in place. Additionally, a bumper made of a crushable or depressable material is incorporated in the assembly such that as the fin deploys, it strikes the bumper at approximately 2° before reaching the deployed position. As the fin continues to rotate to the deployed position, the bumper is crushed or depressed to form a large rapidly expanding area of contact and a very rapidly increasing spring rate, thereby avoiding the fin rebounding encountered previously.

DESCRIPTION OF THE PREFERRED EMBODIMENT

Figure 1:
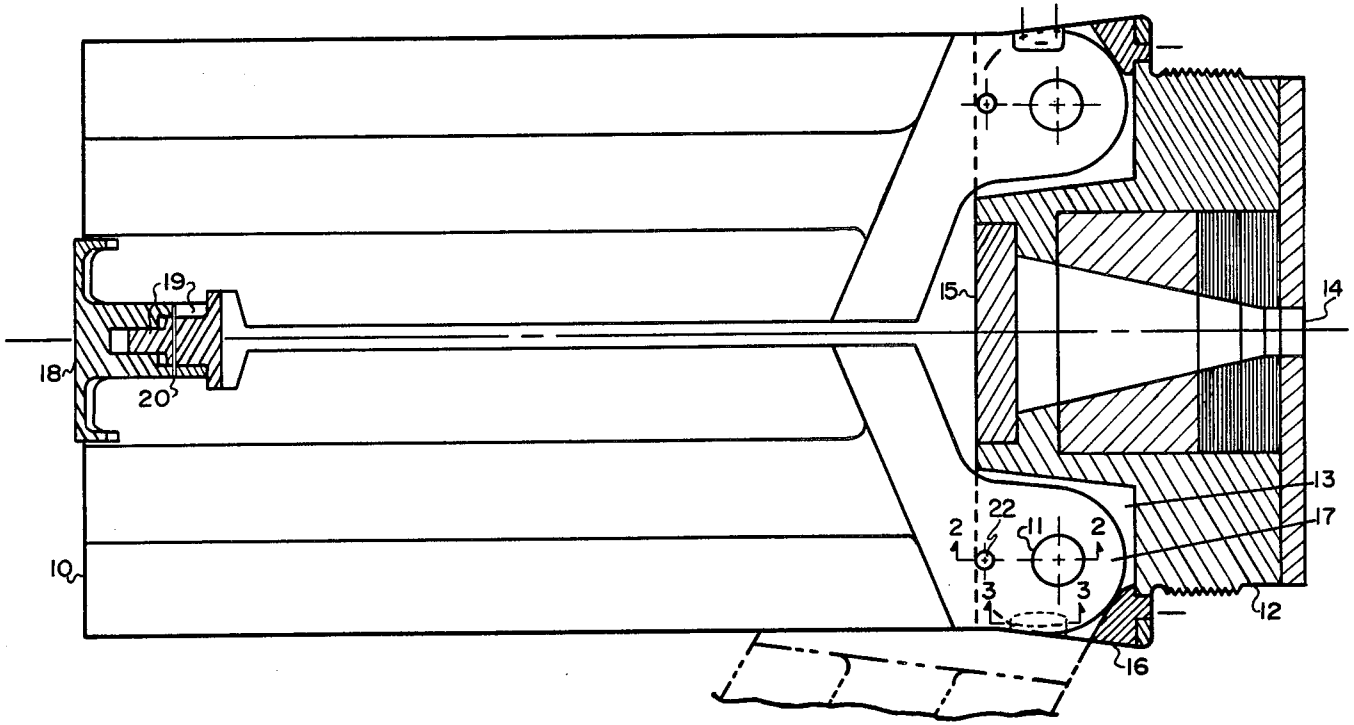
FIG. 1 is a cross section through the fin assembly showing two of the fins in retained position.

In that the fin assembly is symmetrical about the center axis as shown in FIG. 1, the description of the preferred embodiment will be made with respect to one fin only. Fin 10 is rotatedly mounted on fin hinge pin 11 which is journaled in a base plate assembly 12. A fin slot wall 13 is formed such as by machining or casting in the base plate assembly. Also machined in the base plate assembly 12 is a rocket nozzle 14 which is covered prior to rocket motor ignition by a nozzle cover 15.

A depressable or crushable bumper 16 is fixed in the bottom of the fin slot 13 and makes line contact with hub portion 17 of fin 10. Fin 10 is shown in deployed position in dotted lines in FIG. 1.

The fins of which fin, 10 is one, are held in retained position by fin retainer 18 which has a mushroom shaped configuration. Piston member 19 is carried internally of the retainer 18. Retainer wire 20 is retained within a hole drilled transversely through the piston 19 and retainer 18.

Figure 2:
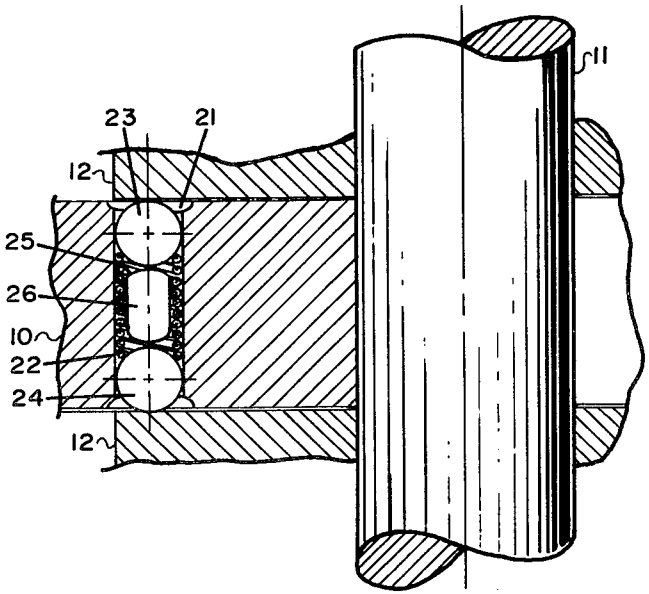
FIG. 2 is a section along lines 2—2 in FIG. 1.

FIG. 2 illustrates the ball detent assembly when the fin is in the retained position. A hole 22 is formed in the fin hub 10 and chamfered at 21 on both ends as shown. Contained within the hole 22 are dual balls 23 and 24 which are spring loaded apart by spring 25. A spacer 26 is included inside the spring between the two balls. The spacer 26 is not required in a non-gun launch environment. However, in a pressurized launch environment such as when the assembly is launched by firing from a gun, the spacer between the two balls prevents the balls from compressing the spring to its solid height.

Figure 3:
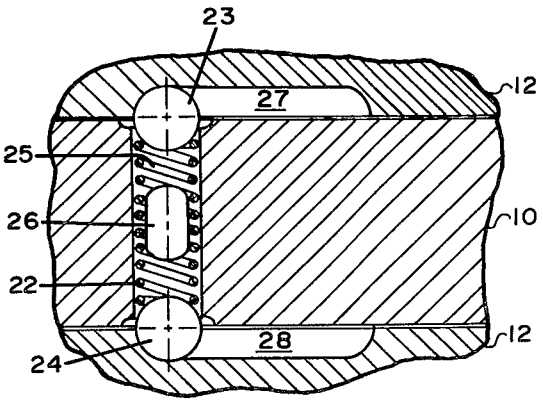
FIG. 3 is a section along lines 3—3 of FIG. 1.

FIG. 3 illustrates fin 10 in deployed position with the balls 23 and 24 shown as forced into grooves 27 and 28 cut into the fin slot walls as with a ball end mill, thus eliminating stress concentrations.

In operation, the fin assembly is attached to a rocket motor and the entire assembly then is fired from a gun tube. Upon firing, retainer 18 is driven to the right with respect to FIG. 1 which shears retainer wire 20 due to the interaction with piston 19. As the fin assembly clears the gun tube, the fins, due to centrifugal force imparted by the spinning of the projectile, rotate from the retained position to the deployed position; the retainer 18 and piston 19 having fallen away due to the rearward flow of air.

The two spring loaded balls 23 and 24 are held in the compressed position by the fin slot walls in the base plate 12 as shown in FIG. 2. The balls ride on the fin slot walls in the base plate until the fin rotates to the deployed position as shown in FIG. 3. Spring 25 then forces the balls into 27 and 28 which are cut in the fin slot walls.

The spacer 26, spring 25, balls 23 and 24, fin hinge pin 11, and the surfaces of the fin that interface with the fin slot in the base plate are all coated with a corrosion inhibiting dry film lubricant before assembly.

As the fin deploys, it strikes the bumper 16 approximately 2° before reaching the deployed position. At this point, only line contact is made between the fin and bumper. As the fin continues to rotate to the deployed position, the bumper 16 is crushed or depressed to form a large rapidly expanding area of contact and a very rapidly increasing spring rate. As the fin rotates past the deployed position, a slight further increase in contact area and spring rate results. The bumper 16 can be made of any efficient, energy absorbing material such as mild steel.

The chamfers such as at 21 in the ball detent hole 22 in the fin provide a line contact on the balls 23 and 25 that is below the ball center lines, thus effecting an over the center locking feature. As pressure increases, the balls are forced outward against the steps 27 and 28 in the fin slot in the base plate as opposed to a tendency to force the balls back into the hole. This feature also provides an equalizing pressure on the fin which centers the fin in the fin slot of the base plate.

The energy absorbing feature in the bumper 16 combined with the rapidly expanding spring rate and area of contact design eliminates the rebound and rebound cycling of the fins.

This method of holding the fins in the deployed position offers many advantages over the methods presently or previously in use. The balls and the springs are low cost, off-the-shelf items, while the spacer is required only when the folding fin ball detent assembly is launched from a pressurized environment. Also, the high structural integrity of the fin hub is preserved and the fin is centered in the fin slot by the equalizing pressure of the balls on the fin which provides improved fin symmetry and missile accuracy. In addition, tolerance build up is significantly reduced which also improves fin symmetry. Fin rebound and rebound cycling are eliminated, which results in reduction of shear loads on the balls to those induced by aerodynamic loading. Also, the dual over-the-center locking feature provides stop redundance. Finally, the entire assembly is easily assembled and lends itself to high production assembly techniques.

What is claimed is:

1. A folding fin assembly for a missile comprising;

at least one pair of fins pivotally mounted on said assembly and movable between a retained position and a deployed position;

a hub portion on each fin of said at least one pair of fins;

a fin hinge pin included in said assembly and associated with each fin of said at least one pair of fins;

each fin being pivotally mounted on an associated fin hinge pin;

said at least one pair of fins being held in the deployed position by a double ball detent assembly;

a hole extending through each hub portion parallel to each fin hinge pin;

said double ball detent assembly being contained in the hole extending through the hub portion.

2. A folding fin assembly as set forth in claim 1 wherein;

said double ball detent assembly comprises two spring loaded balls.

3. A folding fin assembly as set forth in claim 2 and further including;

spacer means inserted inside the spring between the two balls to prevent the balls from compressing the spring to its solid height in a pressurized launch environment such as when the assembly is launched by firing from a gun.

4. A folding fin assembly as set forth in claim 3 and further including;

fin slots in said assembly for each of said at least one pair of fins;

said fin slots lying adjacent to the fin hub; and said fin hinge pin being journaled in said fin slot; and grooves cut into the fin slot walls to receive the balls when the fin are in the deployed position.

5. A folding fin assembly as set forth in claim 4 and further including;

bumper means contained within the assembly such that as the fin deploys it strikes the bumper just before reaching the fully deployed position.

6. A folding fin assembly as set forth in claim 5 wherein;

said bumper material is made of an energy absorbing material which is crushable or depressable.

* * * * *